US006202769B1

(12) United States Patent
Ikegaya et al.

(10) Patent No.: US 6,202,769 B1
(45) Date of Patent: Mar. 20, 2001

(54) DRILLING STABILIZER

(75) Inventors: Akihiko Ikegaya; Keiichi Tsuda, both of Itami (JP)

(73) Assignees: Japanese National Oil Corporation; Japan Research and Development Center for Metals, both of Tokyo (JP)

( * ) Notice: Subject to any disclaimer, the term of this patent is extended or adjusted under 35 U.S.C. 154(b) by 0 days.

(21) Appl. No.: 09/321,224

(22) Filed: May 27, 1999

(30) Foreign Application Priority Data

May 28, 1998 (JP) ..... 10-147649

(51) Int. Cl.[7] ..... E21B 10/36

(52) U.S. Cl. ..... 175/428; 175/430; 175/431; 175/432; 428/557; 51/295; 51/297

(58) Field of Search ..... 175/327, 425, 175/428, 430–432; 428/557; 51/295, 297

(56) References Cited

U.S. PATENT DOCUMENTS 4,610,320 * 9/1986 Beakley ..... 175/409
5,755,299 * 5/1998 Langford et al. ..... 175/375
5,979,579 * 11/1999 Jurewicz ..... 175/434

FOREIGN PATENT DOCUMENTS 9-194909 7/1997 (JP) .

OTHER PUBLICATIONS

"Study on the Composition Graded Cemented Carbides/Steel Composite by Spark Plasma Sintering," Katsuya Uchino, Akihiko Ikegaya, Toshio Nomura, Tsugio Miyagawa and Hidenori Kaneta. *Journal of the Japan Society of Powder and Powder Metallurgy*, vol. 43 (1996), pp. 472–477.

Study on the Composition Graded Cemented Carbide–Steel Composite Material for Drilling Tools, Katsuya Uchino, Akihiko Ikegaya, Toshio Nomura, Tsugio Miyagawa, and Hidenori Kaneta. *Petroleum Technology Society.*, (1997).

"Study on the Composition Graded Cemented Carbides/Steel Composite by Spark Plasma Sintering," Katsuya Uchino, Akihiko Ikegaya, Toshio Nomura, Tsugio Miyagawa and Hidenori Kaneta. *Journal of the Japan Society of Powder and Powder Metallurgy*. vol. 44 (1997), pp. 269–274.

* cited by examiner

*Primary Examiner*—Roger Schoeppel
(74) *Attorney, Agent, or Firm*—McDermott, Will & Emery

(57) ABSTRACT

A high-performance drilling stabilizer is provided that is high in both wear resistance and strength. Blades are bonded to a stabilizer body. The blade is split into at least two segments. The blade segments are bonded to the stabilizer body to form the blade. A laminate made of cemented carbide and having a laminate structure made up of at least two layers is bonded to the top of each of the blade segments. The laminate has a thickness of between 1 mm and 5 mm. The cobalt contents of the respective layers decrease stepwise from the innermost layer toward the outermost layer.

6 Claims, 6 Drawing Sheets

PRIOR ART FIG. 6
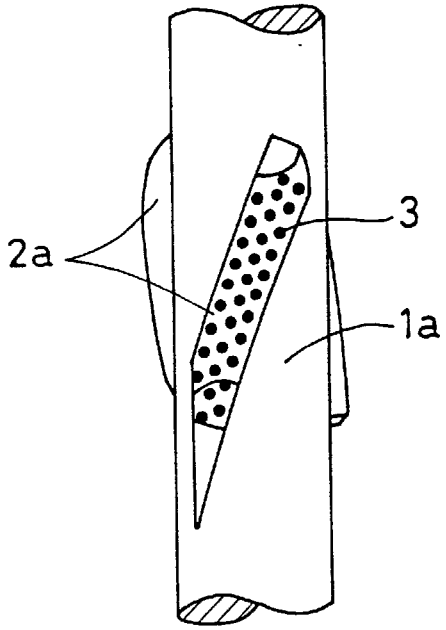
PRIOR ART FIG. 7
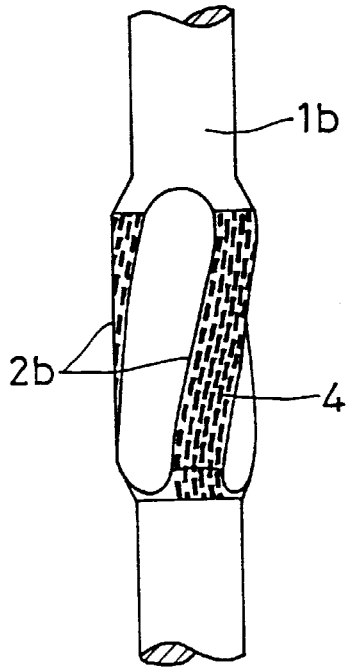

DRILLING STABILIZER

BACKGROUND OF THE INVENTION

The present invention relates to a drilling stabilizer for guiding and stabilizing a drill bit and a drill string for boring an oil or natural gas well.

An oil or natural gas well is drilled by rotating a drill bit connected to the surface through a drill string. A drilling stabilizer is used to guide the drill bit at the tip and the drill string and stabilize their movement. High strength and high wear resistance are required for such a stabilizer because it collides hard against rocky wall of the drilled hole.

FIG. 6 shows a conventional blade-welded type stabilizer having its steel blades 2*a* welded to the outer periphery of its body 1*a*. To improve wear resistance of the blades 2*a,* a plurality of buttons 3 made of cemented carbide are pressed into the surface of each steel blade 2*a,* and the blades 2*a* are welded to the outer periphery of the stabilizer body 1*a*.

As shown in FIG. 7, for a stabilizer having blades 2*b* integral with the stabilizer body 1*b,* cemented carbide inserts 4 are arranged at a high density on each blade 2*b,* and the blades 2*b* are brazed to the surface of a steel blade body 1*b* by use of a hardened brazing filler.

The present inventors disclosed composite materials comprising a steel substrate and cemented carbides bonded by current pressure sintering with gradient composition in unexamined Japanese patent publication 9-194909, and in a Japanese technical magazine "Powder and Powder Metallurgy" vol. 43 (1996), p472 and vol. 44 (1997), p269. These are formed by laminating cemented carbide layers having different compositions. The cemented carbide layer adjacent the steel substrate has a high cobalt content while the cemented carbide layer on the surface side has a low cobalt content to suppress thermal stresses during sintering resulting from a difference in thermal expansion coefficient between the cemented carbide and steel, and to provide a high-hardness outer cemented carbide layer and a high-toughness inner cemented carbide layer. Thus, the inner layer and the surface layer perform separate functions, thereby providing an unprecedented cemented carbide structure that is high in both wear resistance and resistance to chipping.

It is also disclosed that by adjusting the laminate structure, a suitable compressive residual stress is introduced into a surface portion, so that it is possible to improve the resistance to chipping of the cemented carbide portion.

The present inventors also disclosed in Collection of Articles published by Petroleum Technology Society, 1996, P103 that high performance can be expected by using the cemented carbide/steel material of a gradient composition in the blade-welded type stabilizer shown in FIG. 8 and by bonding the above-mentioned laminate 5 over the entire top surface of each blade 2*c* provided on the stabilizer body 1*c*.

In the conventional arrangement in which cemented carbide buttons are buried in a steel blade, since steel and cemented carbide widely differ in wear resistance, the steel portion, which is inferior in wear resistance, tends to wear more quickly in use than the cemented carbide portions, so that the cemented carbide buttons tend to protrude from the steel. This increases the possibility of chipping of the cemented carbide buttons, resulting in the shortening of life. Further, in the conventional type, the corner of the blade has to be necessarily formed from steel, so that the blade ridges tend to be damaged which collide against the wall of the drilled hole.

Also, in the conventional button-buried type, in order to improve wear resistance, it is necessary to increase the number of cemented carbide buttons pressed into steel. But since the buttons have to be supported by the steel substrate, the number of buttons that can be buried in the substrate is limited. About 30% is the upper limit in the ratio of area of buttons to the entire surface area of the steel substrate. Thus, to improve wear resistance, that of the cemented carbide buttons is important. For this purpose, cemented carbide containing 7–9% Co is used. But cemented carbide having this composition tends to chip during use. That is, such a cemented carbide is low in resistance to chipping.

Further, the blades 1*a*–1*c* of the conventional stabilizers have a rectangular shape with one side longer than the other side. In order to form blades having such a rectangular shape in a current pressure sintering apparatus, a large facility is needed, so that the manufacturing cost tends to be high.

Further, if a cemented carbide member is bonded to the entire surface of the blades of the stabilizer except its sides, i.e. the entire top surface, the outer ridges of the blades will be of cemented carbide instead of conventional steel, so that the ridges, which collide first against the wall of the drilled hole, tend to chip.

Also, different loads act on different portions of the blades of the stabilizer, and during use of the stabilizer, lower portions tend to be damaged more severely than upper portions, so that the lower slope tends to be damaged most severely while the upper slope tends to be the least damaged. Since different portions are damaged to different degrees, it was desired to improve durability of blades by remedying such uneven damage. In the cemented carbide button-buried arrangement, according to the degree of damage, the number of cemented carbide buttons is changed to increase the surface area ratio of cemented carbide at portions that tend to be damaged. But the adjustable range is limited.

The blades had a top surface comprising a central curved surface and slopes at both ends. Since the slopes are flat and the ridges forming the boundaries between the central curved surface and the flat slopes at both ends are angular, stresses tend to concentrate on the ridges. In the case of steel, this is no problem. But if a cemented carbide member is bonded to the steel substrate over its entire surface, it tends to be damaged due to stress concentration on the ridges.

Further, in future, stabilizers will have to be used in increasingly hostile environments because they are expected to be used not only to dig deeper holes but many oblique and even horizontal holes from a single rig besides vertical holes to dig oil and natural gas. Thus, it is desired to further improve wear resistance and strength of the blades of stabilizers because these factors greatly influence the life of the stabilizers.

An object of this invention is to provide a high-performance drilling stabilizer that is high in both wear resistance and strength.

SUMMARY OF THE INVENTION

According to this invention, there is provided a drilling stabilizer comprising a stabilizer body and a blade provided on the stabilizer body, the blade being split into at least two segments, the segments being bonded to the stabilizer body to form the blade, wherein a laminate made of cemented carbide and having a laminate structure comprising at least two layers is bonded to the top of each of the blade segments, the laminate having a thickness of 1 to 5 mm, the cobalt contents of cemented carbides of the respective layers of the laminate decreasing stepwise from the innermost layer to be bonded to the blade toward the outermost layer.

Other features and objects of the present invention will become apparent from the following description made with reference to the accompanying drawings, in which:

BRIEF DESCRIPTION OF THE DRAWINGS

FIGS. 6–8 are perspective views of conventional stabilizers.

DETAILED DESCRIPTION OF THE PREFERRED EMBODIMENT

Embodiments of this invention are now described with reference to the drawings.

Figure 1:
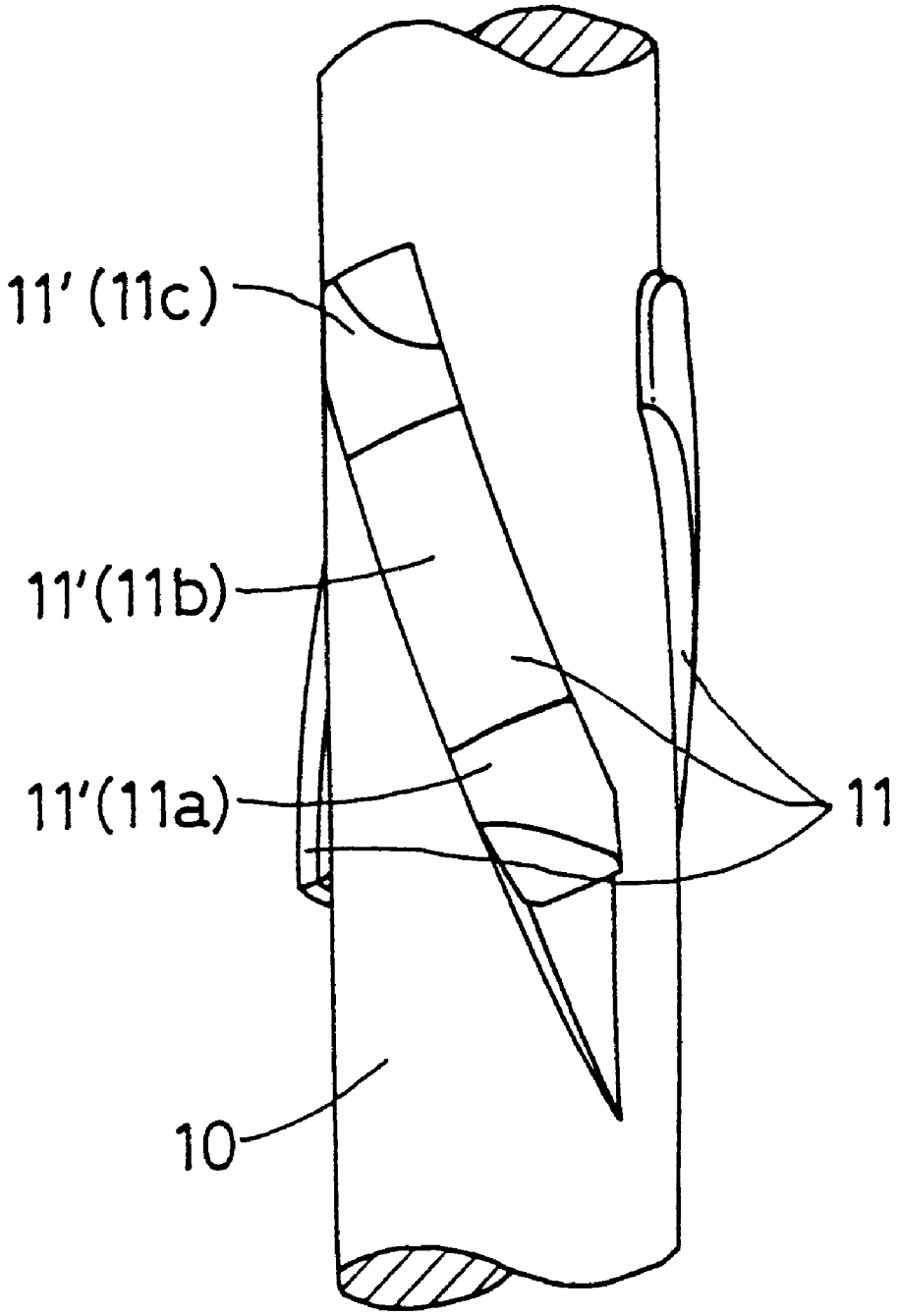
FIG. 1 is a perspective view of a stabilizer embodying this invention.
Figure 2:
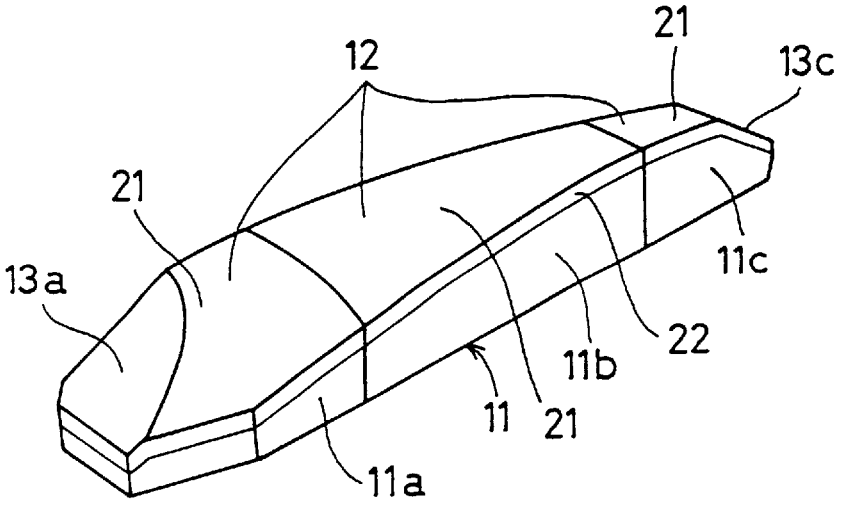
FIG. 2 is a perspective view of a blade of the same.

FIG. 1 shows a drilling stabilizer according to this invention, which comprises a body 10 and blades 11 secured to the circumferential surface of the body 10. The blades 11 are substantially rectangular as shown in FIG. 2. As shown in FIG. 1, the blades 11 are secured to the body 10 at a predetermined angle with respect to the axis of the body. As a natural result, the blades 11 are twisted to some degree along the circumferential surface of the body 10. The angle of the blades 11 with respect to the axis of the body 10 is not limited but determined depending upon the conditions under which the stabilizer is used.

Each blade 11 is made up of at least two blade segments 11'. In FIG. 2, each blade 11 comprises three split blades or blade segments, i.e. an upper blade 11*a,* a middle blade 11*b* and a lower blade 11*c.* The split blades are arranged in a predetermined order and bonded to the body 10 to form the blade 11 as shown in FIG. 1. If each blade comprises three split blades, when using the stabilizer, the upper, middle and lower blades are bonded to the body 10 with the upper blade 11*a* disposed at an upper portion, the lower blade 11*c* at a lower portion, and the middle blade 11*b* therebetween.

If the blade 11 is rectangular, a large graphite sintering mold and a correspondingly large current pressure sintering apparatus are needed for sintering a laminated material which is described hereinbelow. This may push up the manufacturing cost. Thus, each blade 11 is preferably split longitudinally so that the long side is shorter than 2.5 times the short side. If it is split such that the upper and lower split blades are symmetrical, it is possible to reduce the kinds of steel substrates and graphite molds used. Thus, to reduce the cost, one should split the blades this way.

A cemented carbide laminate 12 is bonded to the entire surface of each split blade 11' except its sides, that is, its entire top surface. The laminate 12 is 1–5 mm thick. The reason why the laminate 12 is bonded to the entire top surface of each split blade 11' and not to its side is because the top surface tends to be worn or damaged much more severely by coming into contact with the wall of the drilled hole than its side.

The thickness of the laminate should preferably be set to 1–5 mm because if thinner than 1 mm, wear resistance is not enough, and if thicker than 5 mm, the cemented carbide portion would determine and thus reduce the strength of the entire composite, and also the manufacturing cost tends to increase.

The laminate 12 comprises at least two layers of cemented carbide having different compositions. The cobalt content of each cemented carbide layer should be smaller than that of the layer immediately inside of said each layer when the laminate 12 is bonded to each split blade 11'.

The reason why the laminate 12 has a laminate structure comprising at least two layers is because by adjusting the Co contents of the respective layers such that the innermost layer to be bonded to the steel substrate has the highest Co content and the outermost layer has the lowest Co content, it is possible to suppress thermal stresses during sintering resulting from a difference in thermal expansion coefficient between the cemented carbide and the steel, thereby achieving good sintering. Also with this arrangement, since the outermost layer is a high-hardness cemented carbide and the inner layer is a tough cemented carbide, the surface and the inner layers perform separate functions, and a cemented carbide resistant to both wear and chipping is provided at the surface portion.

The laminate 12 is bonded to a split blade 11' by current pressure sintering. For example, a steel blade is set in a graphite mold, cemented carbide powder having a composition for the layer to be bonded to the blade is poured into the mold along the blade, and is preformed by use of a graphite punch having a shape complementary to the blade. Then, cemented carbide powder having a composition for the second layer is poured into the mold along the blade and preformed by use of a graphite punch complementary in shape to the blade. This operation is repeated to form an intended laminated structure. After cemented carbide powder has been laminated, the entire specimen is set in a current pressure sintering apparatus together with the graphite mold for pressure sintering. A blade having a laminate bonded thereto is thus formed.

Figure 3A:
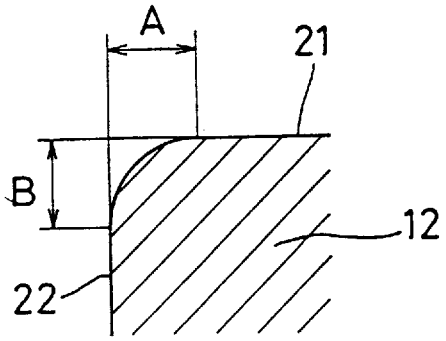
FIG. 3A is a sectional view showing a chamfered outer ridge on the surface of the blade of FIG. 2.

A cemented carbide laminate of the above type is bonded by sintering to the entire top surface of each split blade 11'. Thus, the ridge on the outer peripheral surface of each split blade 11' is defined by cemented carbide. If the ridge is angular, it tends to chip. Thus, it should be rounded or chamfered. Referring to FIG. 3A, which shows a vertical section of the laminate 12, the ridge is preferably chamferred such that the amount A of chamfering of the top surface 21 is 1–3 mm and the ratio of A to B, which is the amount of chamfering of the side 22, is 0.5–1.5.

If the amount A is smaller than 1 mm, the ridge tends to chip. If greater than 3 mm, an increase in the rotation resistance results in heat buildup and may promote thermal cracks along the ridge. If the A/B ratio is less than 0.5, rotation resistance may increase. If greater than 1.5, the ridge tends to chip.

At both ends of the blade 11, as shown in FIG. 2, slopes 13*a,* 13*c* are formed. These slopes extend from the top 21 of the blade 11 toward the circumferential surface of the stabilizer body 10 when the blade 11 is bonded to the body 10. If the blade 11 comprises three split blades, i.e. an upper blade 11*a,* a middle blade 11*b* and a lower blade 11*c,* the slopes 13*a* and 13*c* are formed at the ends of the top blade 11*a* and the lower blade 11*c,* respectively, such that they extend from the top 21 toward the circumferential surface of the stabilizer 10 when the top blade 11*a,* middle blade 11*b* and lower blade 11*c* are bonded to the stabilizer body 10. Laminates 12 of the above type are bonded to the top surface 21 and the slopes 13*a,* 13*c* of this blade 11 (or upper blade 11*a,* middle blade 11*b* and lower blade 11*c*) in the manner described above.

At this time, the amount of chamfering of the ridge on the outer surface of the laminate 12 bonded to the lower portion of the blade including one of the slopes 13*a* and 13*c* that is located under the other slope during use of the drilling stabilizer is preferably greater than the amounts of chamfering of the ridges on the outer surface of the laminates bonded to the other portions of the blade 11 than the lower portion.

If the blade comprises three longitudinally split blades, the lower portion of the blade 11 can be handled as the lower blade 11*c.* That is, the amounts of chamfering of the ridges on the outer surfaces of the laminates 12 bonded to the top 21 and the slope 13*c* of the lower blade 11*c* are preferably greater than those of the ridges on the outer surface of the laminates 12 bonded to the top 21 of the middle blade 13*b* and the top 21 and slope 13*a* of the upper blade 13*a.*

Different loads act on different portions of the blade 11 when mounted on the body 10. Generally, of the slopes of the blade 11, the slope located on the lower side during use of the stabilizer 10 tends to be damaged more severely, and the slope on the upper side is damaged to a lesser degree. Thus, by chamfering the outer surface of the lower portion of the blade, where the ridge tends to be damaged severely, to a higher degree than other portions, it is possible to compensate for the difference in load at different locations and thus to improve the durability of the entire blade 11.

The laminates 12 bonded to the tops of the split blades 11' may have different laminate structures from one another to prevent uneven damage due to different loads on different portions of the blade 11. By changing the laminate structure of cemented carbide to be bonded to the surface of the substrate, it is possible not only to remedy uneven damage but to improve only the wear resistance or only the resistance to chipping. When compared with the conventional, rather limited adjusting method of changing the number of cemented carbide buttons from one portion to another, the present method can be used in a wider range and can improve the durability of the blade 11 dramatically.

Figure 3B:
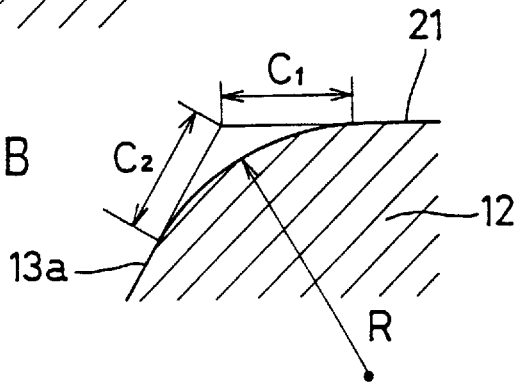
FIG. 3B is a sectional view showing chamfered portion at boundary between the top and slopes of the blade of FIG. 2.

Ridges of the boundaries between the top 21 and the slopes 13*a* and 13*c* of the laminates 12 bonded to the blade 11 may be chamfered. As shown in FIG. 3B, the radius of curvature R at the ridge is preferably 5 mm or over, more preferably 5–25 mm. The sum of the chamfering dimension C2 of the slopes 13*a,* 13*c* and the chamfering dimension C1 of the top 21 is preferably 2–10 mm, more preferably 2–5 mm.

For a blade having slopes 13*a,* 13*c* at both ends, stresses tend to concentrate on the ridges connecting the top 21 to the slopes 13*a,* 13*c.* The laminates 12 tend to be broken at these portions. Thus, by chamfering these portions, it is possible to lessen stress concentration and thus prevent chipping of the laminates along the ridges.

If the radius of curvature is less than 5 mm, or if the chamfering dimension is less than 2 mm, stresses decrease only insufficiently. If the chamfering dimension is over 10 mm, this reduces the area of the top 21.

The laminate 12 bonded to each split blade 11' has a laminate structure. Preferably, the Co content of the cemented carbide forming the outermost layer is 5–25 wt % and the Co content of the cemented carbide forming the layer bonded to the substrate is 25–50 wt %. If the Co content of the outermost layer is less than 5%, chipping tends to happen, though wear resistance is good. If over 25%, wear resistance will be insufficient even if the entire surface is covered with the cemented carbide. If the Co content of the bonded layer is less than 25%, stress suppression will be insufficient. If over 50%, the hardness of the cemented carbide will become lower than that of the steel, and thus the cemented carbide will fail to function as a wear-resistant material.

EXAMPLES

The present invention is now described in more detail by examples but not limited to these examples.

(Example 1 of the invention,
Comparative Example 1)

Figure 4C:
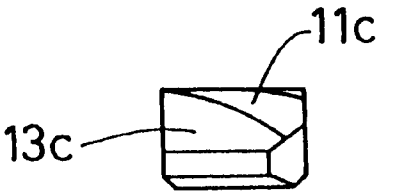
FIG. 4C is a side view of the same.
Figure 4A:
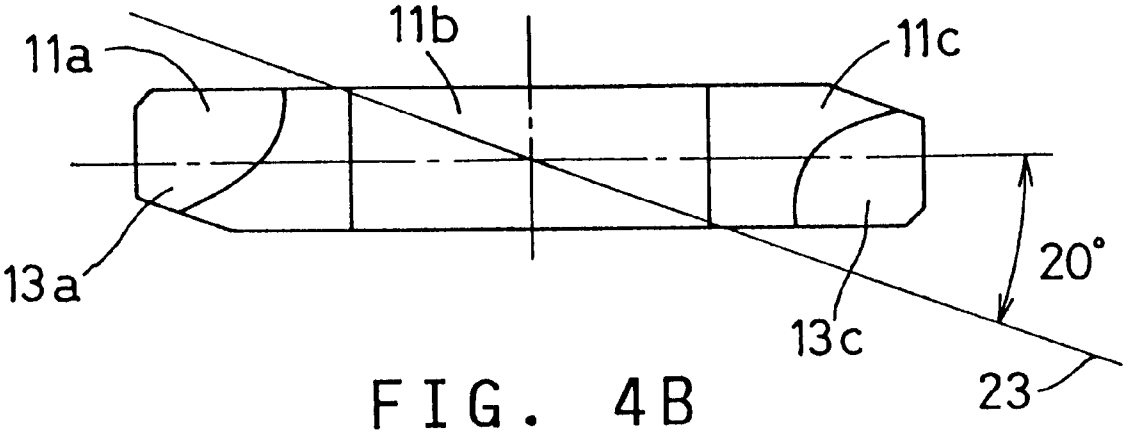
FIG. 4A is a plan view of a blade of a stabilizer embodying this invention.
Figure 4B:
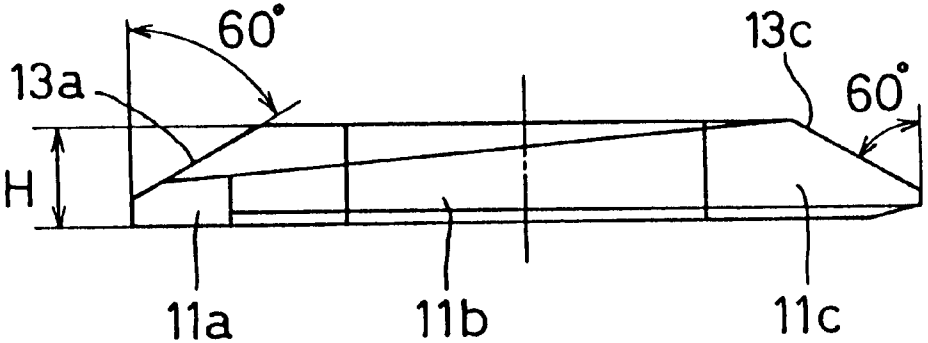
FIG. 4B is a front view of the same.

As an example of the invention, a blade-welded type stabilizer for hole diameter 5–⅝" was selected. Each steel blade had a twisted shape inclined at an angle of 20° with respect to the central axis of the stabilizer body as shown in FIG. 4, and measures 220 mm in length, 40 mm in width and 31 mm in height. The upper blade 11*a* and the lower blade 11*c* had at their ends slopes 13*a* and 13*c,* respectively, inclined at an angle of 60°. The blade was split into three pieces, i.e. a middle piece 100 mm long, and end pieces 60 mm long each. The upper blade 11*a* and the lower blade 11*c* were symmetrical and identical in shape. The height H of the steel blade was lower than the conventional type in which cemented carbide buttons are buried, by an amount equal to the thickness of the cemented carbide portion.

Laminates of cemented carbide having different laminate structures were formed on the top of the middle blades 11*b* in the manner described below.

A steel (JIS: S35C) blade was set in a graphite mold, and cemented carbide powder having a composition as shown in Table 1 as the first layer was poured onto its surface to the shape of the blade in such an amount that a layer of an intended thickness would be formed after sintering, and then preformed by use of a graphite punch complementary in shape to the blade. Then, cemented carbide powder having a composition as the second layer shown in Table 1 was poured into the mold along the blade and preformed by use of a graphite punch complementary in shape to the blade.

This operation was repeated until an intended laminated structure was formed. After cemented carbide powder had been laminated, the entire specimen was set in a current pressure sintering apparatus together with the graphite mold for current pressure sintering. Middle blades to which were bonded laminates having laminate structures shown in Table 1 (Specimens 1–5 of the invention and Comparative Specimens 1–7) were thus formed.

In Table 1, the first layer is the layer bonded to the top of the middle blade and the second, third and fourth layers are provided immediately outside the first, second and third layers, respectively.

For comparison, Comparative Specimens 8 and 9 were prepared, which were steel (JIS: S35C) blades in which were buried cemented carbide buttons having a composition of WC-8% Co, and those having a composition of WC-10% Co, respectively. The cemented carbide buttons were 8 mm in diameter and 15 mm long, and were arranged so that the total surface area of the buttons would be 10% of the entire surface area of the blade.

Table 1 shows the structure of the blades thus formed.

Blast erosion test and impact test

Specimens 1–5 of the invention and Comparative Specimens 1–9 were subjected to a blast erosion test to determine the wear resistance. In the test, alumina media was blown against the specimen to determine the erosion characteristics from the amount of wear. The test was conducted under conditions selected to allow relative determination of differences in wear resistance between blades.

In tests for determining the resistance to chipping, in order to reproduce the actual use condition in which blade surfaces collide hard against rocky wall of the drilled hole, a cemented carbide (WC-10% Co) ball 25 mm diameter was hit 150 times against each blade at the force of 20J. To determine wear resistance, the amount of wear was converted to a volumetric value based on observation of the damage of each blade tested and reduction in weight. The results are shown in Table 2. To determine the resistance to chipping, damage to each specimen was observed after the test. The results are also shown in Table 2.

Results

As a result of the wear resistance test, it was confirmed that Blade Specimens 1–5 of the invention and Blade Specimens 1–7 for comparison in which cemented carbide laminates were bonded to steel blades over the entire surface thereof, showed normal wear. The lower the Co content of the outermost cemented carbide layer, the smaller the amount of wear and the higher the wear resistance. The wear was especially remarkable for Blade Specimen 2 for comparison in which the Co content exceeded the range specified in the present invention. For Blade Specimen 4 for comparison, in which the laminate had a thickness smaller than the value specified according to the invention, the wear was remarkable when compared with Blade Specimen 2 of the invention and Blade Specimen 5 for comparison, in which the outermost layers had the same composition. On the other hand, for Blade Specimens 8 and 9 for comparison, the steel portion, which was low in wear resistance, was worn more quickly than the cemented carbide buttons buried therein, so that the cemented carbide buttons protruded from the steel substrate, making the blades useless.

Among Blade Specimens 1–5 of the invention and Blade Specimens 1–7 for comparison, in which cemented carbide members were bonded to the steel blade over the entire surface thereof, cracks were observed in Specimens 1 and 5–7 for comparison. Specimen 1 for comparison had a single-layered laminate, so that the thermal stress suppressing effect was presumably insufficient. For Specimen 5 for comparison, in which the laminate had a thickness larger than the value specified according to the invention, the impact strength of the laminate was presumably prevailing. For Specimen 6 for comparison, in which the Co content of the outermost cemented carbide layer was smaller than the value specified according to the present invention, the toughness and the stress suppressing effect of the laminate were presumably insufficient, though the wear resistance was high. For Specimen 7 for comparison, in which the Co content of the innermost layer bonded to the substrate was smaller than the value specified according to the present invention, the toughness and the stress suppressing effect of the bonding layer were presumably insufficient. On the other hand, for Specimens 8 and 9 for comparison, the cemented carbide members protruded due to impact and the protruding portion chipped.

(Example 2 of the invention and Comparative Example 2)

Figure 5A:
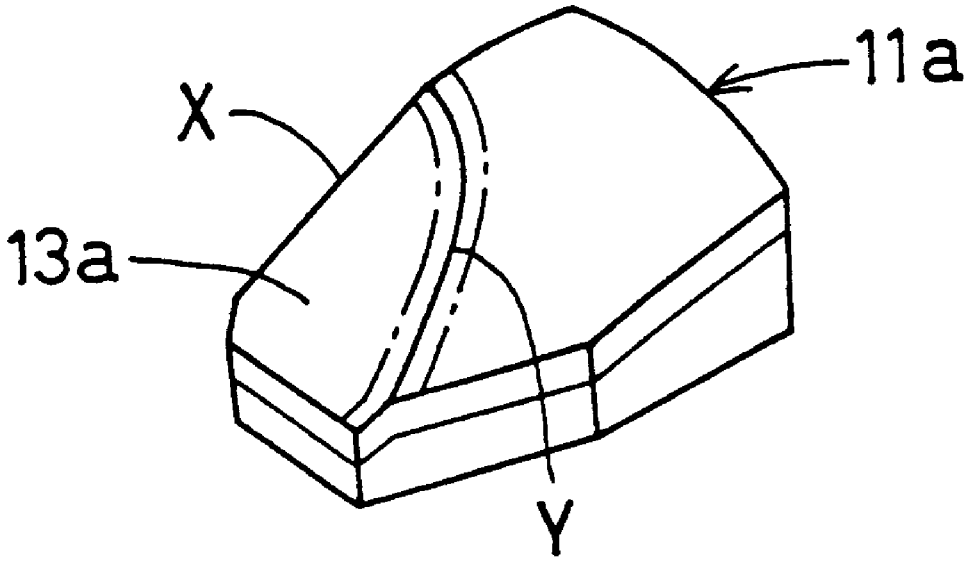
FIG. 5A is a perspective view of an upper blade of FIG. 2.

Laminates used for Specimen 2 of Example 1 of the invention was bonded by sintering to the top and slopes of the upper blade 11*a* by the above method. The outer ridge X (FIG. 5A) of the surface of each laminate was chamfered under the conditions shown in Table 3. The ridge Y (FIG. 5A) forming the boundary between the slope 13*a* and the top was chamfered under the conditions shown in Table 3 to form a curved surface having a predetermined radius of curvature R (FIG. 3B). The letter C in Table 3 indicates the sum of the chamfering dimension (C1) of the slope 13*a* and the chamfering dimension (C2) of the top.

By these treatments, Specimens 1–3 of the invention and Specimens 1–4 for comparison were prepared. An upper blade structurally identical to Specimen 9 for comparison in Example 1 of the invention was prepared as Specimen 5 for comparison.

Figure 5B:
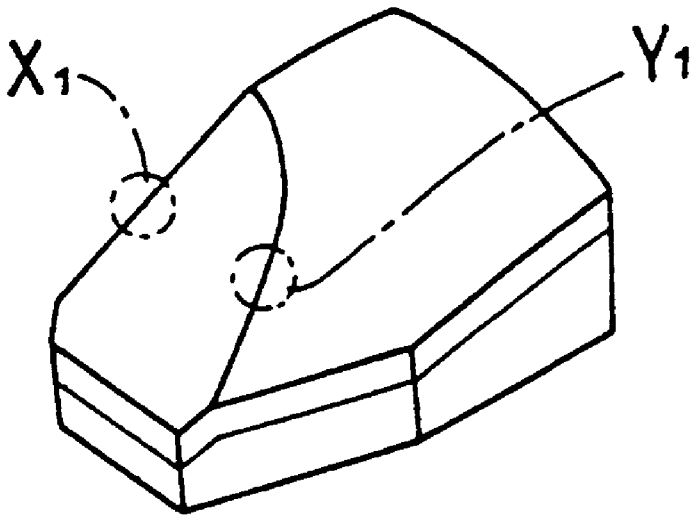
FIG. 5B is a similar view showing the positions subjected to an impact test.
Figure 8:
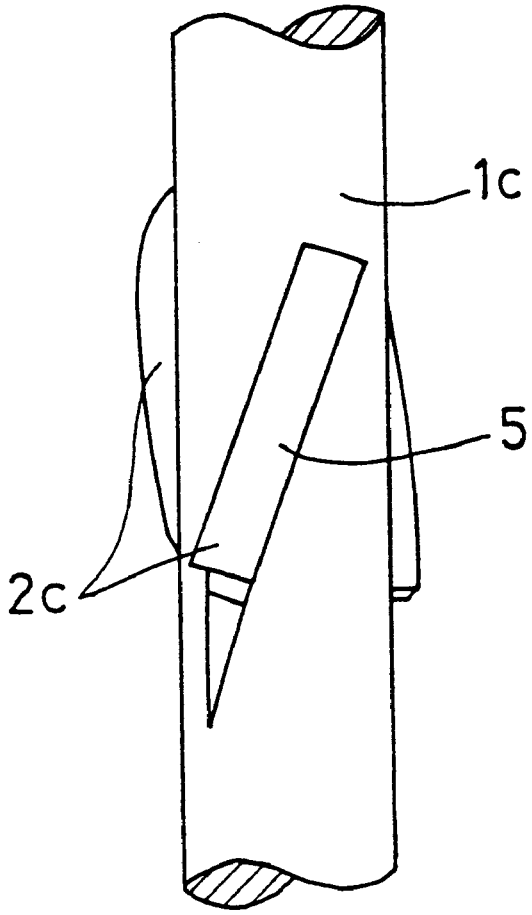
PRIOR ART FIG. 8

After an impact test in which a flat plate of cemented carbide (WC-10% Co) was hit 20 times against each specimen along the outer ridge X1 (FIG. 5B) under the force of 10J, the specimens were observed. In another impact test, a cemented carbide (WC-10% Co) ball 25 mm in diameter was hit 50 times against each specimen along the ridge Y1 (FIG. 5B). After the test, each specimen was observed to determine how severe the damages to the outer ridge of each laminate and the ridge forming the boundary between the top and the slope were. The results are shown in Table 4.

Results

For Specimens 1–3 of the invention, which were treated as specified according to the present invention, no damage was observed along the outer ridge of the laminate or the ridge forming the boundary between the top and each slope. For Specimens 2 and 4 for comparison, which were not treated as specified according to the present invention, chipping was observed both along the outer ridge of the laminate and the ridge forming the boundary between the top and each slope. For Specimen 5 for comparison, the steel substrate deformed markedly along the outer ridge, and along the ridge forming the boundary between the top and each slope, the steel substrate deformed markedly and bit into the blade, and cemented carbide buttons chipped. For Specimens 1 and 3 for comparison, in which the outer ridge of the laminate and the ridge forming the boundary between the top and each slope were both chamfered to a greater degree than the chamfering amount specified according to the present invention, no chipping was observed. But due to large chamfering amount, frictional resistance between the wall of the hole and the blade tends to be high along the ridges. This increases the possibility of thermal cracks along the ridges due to heat buildup.

(Example 3 of the invention)

An upper blade having the shape as described in Example 1 of the invention and having a laminate having the same laminate structure as the Specimen 4 of Example 1 of the invention was prepared, and the outer ridge and the ridge forming the boundary between the top and each slope were chamfered under the same conditions used for Specimen 2 of Example 2 of the invention in Table 3.

A lower blade having the shape as described in Example 1 of the invention and having a laminate having the same laminate structure as the Specimen 3 of Example 1 of the invention was prepared, and the outer ridge and the ridge forming the boundary between the top and each slope were chamfered under the same conditions used for Specimen 1 of the invention in Table 3.

A middle blade having the shape as described in Example 1 of the invention and having a laminate having the same laminate structure as the Specimen 2 of Example 1 of the invention was prepared, and the outer ridge and the ridge forming the boundary between the top and each slope were chamfered under the same conditions used for Specimen 3 of the invention in Table 3.

Cutouts for fixing blades were formed in a stabilizer body which was 3.½" in inner diameter, 4.¾" in outer diameter and 1000 mm long, and three sets of the abovementioned upper, middle and lower blades were welded to the stabilizer body. Welding steps comprised preheating of the body, temporary fastening of the blades, underlaying weld, and final weld. After welding, the stabilizer was post-heated and then cooled slowly in ashes. As a result of magnaflux inspection after welding, no chipping or cracks were found in the cemented carbide portion. This shows that the welding was sound. When compared with conventional blades, there was no particular problem about weldability.

According to this invention, a laminate of cemented carbide is bonded to the top of the blade, and the Co contents of the respective layers of the laminate are adjusted separately. Thus, it is possible to improve the bonding performance between the blade and the steel and to improve the hardness of the outermost layer. Thus, a high-performance stabilizer that is high in both wear resistance and strength is provided.

Since the blade is split into a plurality of segments, laminates can be bonded thereto more easily. It is also possible to change the laminate structures of the laminates from one segment to another, so that it is possible to bond a laminate having suitable frictional resistance and hardness to each segment according to the load applied to the blade.

TABLE 2

| blades | blast erosion test | | impact test |
|---|---|---|---|
| used | how damaged | amount of wear ($mm^3$) | How damaged |
| | | Example 1 | |
| test blades | | | |
| 1 | normal wear | 9.6 | no damaqe |
| 2 | normal wear | 4.2 | no damage |
| 3 | normal wear | 2.0 | no damage |
| 4 | normal wear | 5.6 | no damage |
| 5 | normal wear | 1.4 | no damage |
| | | Comparative Example 1 | |
| comparative test blades | | | |
| 1 | normal wear | 10.7 | cracks developed |
| 2 | normal wear | 14.3 | no damage |
| 3 | normal wear | 10.2 | no damage |
| 4 | normal wear | 7.2 | no damage |
| 5 | normal wear | 3.8 | cracks developed |
| 6 | normal wear | 1.0 | cracks developed |
| 7 | normal wear | 1.5 | cracks developed |
| 8 | steel substrate worn abnormally | unmeasurable | cemented carbide buttons chipped |
| 9 | steel substrate worn abnormally | unmeasurable | cemented carbide buttons chipped |

TABLE 1

| | laminate structure | | | | | | | | |
|---|---|---|---|---|---|---|---|---|---|
| | fourth layer | | third layer | | second layer | | first layer | | |
| | composition | thickness (mm) | composition | thickness (mm) | composition | thickness (mm) | composition | thickness (mm) | blade body |
| test blade | | | | | | | | | |
| 1 | | | | | WC-23% Co | 1.5 | WC-48% Co | 1.5 | steel (S35C) |
| 2 | | | WC-10% Co | 1.0 | WC-20% Co | 1.0 | WC-30% Co | 1.0 | steel (S35C) |
| 3 | | | WC- 8% Co | 1.0 | WC-18% Co | 1.0 | WC-30% Co | 1.0 | steel (S35C) |
| 4 | | | WC-12% Co | 1.0 | WC-22% Co | 1.0 | WC-35% Co | 1.0 | steel (S35C) |
| 5 | WC- 5% Co | 0.5 | WC-10% Co | 0.5 | WC-20% Co | 1.0 | WC-30% Co | 1.0 | steel (S35C) |
| comparative test blade | | | | | | | | | |
| 1 | | | | | | | WC-25% Co | 3 | steel (S35C) |
| 2 | | | | | WC-27% Co | 1.5 | WC-44% Co | 1.5 | steel (S35C) |
| 3 | | | | | WC-25% Co | 1.5 | WC-55% Co | 1.5 | steel (S35C) |
| 4 | | | WC-10% Co | 0.3 | WC-20% Co | 0.3 | WC-30% Co | 0.3 | steel (S35C) |
| 5 | | | WC-10% Co | 2.0 | WC-20% Co | 2.0 | WC-30% Co | 2.0 | steel (S35C) |
| 6 | WC- 4% Co | 0.5 | WC- 8% Co | 0.5 | WC-18% Co | 1.0 | WC-30% Co | 1.0 | steel (S35C) |
| 7 | WC- 5% Co | 0.5 | WC-10% Co | 0.5 | WC-16% Co | 1.0 | WC-23% Co | 1.0 | steel (S35C) |
| 8 | steel blade with WC- 8% Co cemented carbide buttons buried | | | | | | | | |
| 9 | steel blade with WC-10% Co cemented carbide buttons buried | | | | | | | | |

TABLE 3

| | | ridge at outer periphery ($X_1$) | | | ridges between slope and top ($Y_1$) radius of | |
|---|---|---|---|---|---|---|
| | blades used | A (mm) | B (mm) | A/B | curvature (mm) | C (mm) |
| | | Example 2 | | | | |
| specimens | | | | | | |
| 1 | test blade 2 | 1.5 | 1.5 | 1.0 | 8.0 | 3.5 |
| 2 | test blade 2 | 1.1 | 1.7 | 0.7 | 5.5 | 4.8 |
| 3 | test blade 2 | 1.4 | 1.0 | 1.4 | 8.0 | 2.2 |
| | | Comparative Example 2 | | | | |
| comparative specimens | | | | | | |
| 1 | test blade 2 | 3.5 | 2.5 | 1.4 | 8.0 | 8.0 |
| 2 | test blade 2 | 0.8 | 0.8 | 1.0 | 4.0 | 3.5 |
| 3 | test blade 2 | 1.5 | 3.5 | 0.4 | 8.0 | 5.5 |
| 4 | test blade 2 | 1.5 | 0.9 | 1.7 | 8.0 | 1.0 |
| 5 | comparative test blade 9 | 1.5 | 1.5 | 1.0 | 8.0 | 3.5 |

TABLE 4

| | outer peripheral ridge ($X_1$) | ridges between slope and top ($Y_1$) |
|---|---|---|
| | Example 2 | |
| specimens | | |
| 1 | no damage | no damage |
| 2 | no damage | no damage |
| 3 | no damage | no damage |
| | Comparative Example 2 | |
| comparative specimens | | |
| 1 | no damage | no damage |
| 2 | cemented carbide portion chipped | cemented carbide portion chipped |
| 3 | no damage | no damage |
| 4 | cemented carbide portion chipped | cemented carbide portion chipped |
| 5 | ridges deformed markedly | ridges deformed markedly |

What is claimed is:

1. A drilling stabilizer comprising a stabilizer body and a blade provided on said stabilizer body, said blade being split into at least two segments, said segments being bonded to said stabilizer body to form said blade, wherein a laminate made of cemented carbide and having a laminate structure comprising at least two layers is bonded to each of said blade segments, said laminate having a thickness of 1 to 5 mm, the cemented carbides of the respective layers of said laminate having cobalt content decreasing stepwise from an innermost layer to be bonded to said blade toward an outermost layer.

2. The stabilizer as claimed in claim 1 wherein said laminate structure has a rounded ridge, a top portion of said laminate having a length of chamfering A of 1–3 mm and a side portion of said laminate having a length of chamfering B, and the ratio of A to B is 0.5–1.5.

3. The stabilizer as claimed in claim 2 wherein said blade is bonded to said stabilizer body at a predetermined angle with respect to the axis of said stabilizer body, said blade having at each end segment thereof a slope extending from its top toward the outer periphery of said stabilizer body, said laminate structure being bonded to said top and said slope of respective blade end segments, the laminate structure bonded to a lower blade end segment having an outer ridge chamfered by a greater amount than an outer ridge of the laminate structure bonded to an upper blade end segment.

4. The stabilizer as claimed in any of claim 1 wherein said laminate bonded to each of said blade segments has a different laminate structure from said laminates bonded to other blade segments.

5. The stabilizer as claimed in claim 3 wherein ridges at boundaries between said top and said slopes of respective blade segments have a radius of curvature of at least 5 mm, and the sum of chamfering dimension at the top surface and the chamfering dimension at said slopes being 2–10 mm.

6. The stabilizer as claimed in claim 1 wherein the cobalt content of the outermost layer of said laminate bonded to each of said blade segments is between 5 wt % and 25 wt %, and the cobalt content of the innermost layer of said laminate is between 25 wt % and 50 wt %.

* * * * *